United States Patent [19]

Santo

[11] 4,338,692

[45] Jul. 13, 1982

[54] BODY-SUPPORT FLOATATION SYSTEM

[76] Inventor: Philip J. Santo, 130 Larkspur La., Rochester, N.Y. 14622

[21] Appl. No.: 767,808

[22] Filed: Feb. 11, 1977

[51] Int. Cl.[3] ..... A47C 29/00

[52] U.S. Cl. ..... 5/451

[58] Field of Search ..... 5/365, 367

[56] References Cited

U.S. PATENT DOCUMENTS

| | | | |
|---|---|---|---|
| 3,663,973 | 5/1972 | Spence | 5/367 |
| 3,689,948 | 9/1972 | Graves et al. | 5/367 |
| 3,787,908 | 1/1974 | Beck et al. | 5/367 |
| 3,810,265 | 5/1974 | McGrew | 5/367 |

*Primary Examiner*—Peter M. Caun

*Attorney, Agent, or Firm*—Lawrence P. Kessler

[57] ABSTRACT

A body-support floatation system comprising a reversible gelatinizing agent added to water within a flexible bladder. Further, a fungicide is added to the gel to inhibit bacterial growth which otherwise would cause deterioration of the gel. As the gelatinizing agent is reacted with the water, the mixture is aspirated so as to carry the mixing of the gelatinizing agent and the water to completion and, to entrap air in the gel to reduce the amount of gel required to fill the bladder, with a proportionate reduction in weight.

1 Claim, No Drawings

BODY-SUPPORT FLOATATION SYSTEM

BACKGROUND OF THE INVENTION

1. Field of the Invention

This invention relates to body-support floatation systems and more particularly to a floatation system including an reversible gel encased in a flexible bladder for such body-support.

2. Description of the Prior Art

It has been known for some time that the human body needs adequate rest to maintain both physical and mental wellbeing. Medical studies show that the average person needs approximately eight hours of rest per twenty-four hour period. Of course, the type of body-support structure used during the rest period has a direct relationship to the adequacy of the rest period.

An an out-growth of the studies to determine the cause of pressure necrosis including decubitus ulcers (commonly called bed sores), it has been concluded that equalized pressure distribution on the body over the entire body-support structure is of primary importance in relieving stress during the rest period. In order to accomplish uniform pressure distribution in body-support structures, inner-spring cushion structures, such as those of the foam rubber and pneumatic type have commonly been employed. However, such structures still can cause areas of localized pressure which restrict blood flow to disrupt the rest period (and if continued for a long period of time, cause bed sores).

Recent efforts to find body-support structures with ideal uniform pressure distribution have resulted in development of liquid support structures generally classified as floatation systems. The most common floatation system, is formed of a flexible bladder filled with a non-compressible liquid, usually water. Such a system equally distributes pressure over all areas of the body in contact with the support structure. However, to provide sufficient support for the average human body, requires a structure of about 1500 pounds in weight. In a structure of this size, motion of the water within the bladder can be objectionable. Another drawback to the use of floatation systems is that the water within the bladder, being stagnate, promotes growth of bacteria which may necessitate the laborious task of periodically emptying the bladder and refilling it with fresh water.

In order to reduce both the weight and motion of the water-containing floatation system, organic fluid-like gells of increased viscosity (with respect to water) have been used, as taught by U.S. Pat. Nos. 3,308,491; 3,548,420; and 3,737,930. The use of gells of increased viscosity will reduce motion within the bladder and will enable an equivalent amount of support to be produced with a reduced quantity of liquid. Organic substances are, however, relatively costly. Further, they are subject to deterioration after a period of time, and replacing the gel presents significant problems not found in standard water-containing floatation system.

SUMMARY OF THE INVENTION

It is the purpose of this invention to provide an effective body-support floatation system of reduced weight which is not subject to deterioration. The proposed body-support floatation system utilizes a reversible gelatinizing agent added to water within a flexible bladder. Further, a fungicide is added to the gel to inhibit bacterial growth which otherwise causes deterioration of the gel. As the gelatinizing agent is reacted with the water, the mixture is aspirated so as to carry the mixing of the gelatinizing agent and the water to completion and, to entrap air in the gel to reduce the amount of gel required to fill the bladder with a proportionate reduction in weight.

DESCRIPTION OF THE PREFERRED EMBODIMENT

The floatation system of this invention includes a flexible bladder configured to support either an entire human body or a portion thereof. The bladder may be composed of a latex rubber or any suitable synthetic elastomeric material, providing it is compatible with the gel to be encased thereby. A suitable filler opening is provided in the bladder to enable the bladder to be filled (or emptied) with a liquid and a reversible gelatinizing agent. To form the gel of this floatation system, the gelatinizing agent and fungicide are directed into the flexible bladder. The bladder is then filled with a liquid, such as water from, for example, a common garden hose. When the liquid contacts the gelatinizing agent it begins to swell and increase in viscosity. Although the force of the liquid as it enters the bladder may cause some turbulence for mixing, to insure complete reaction of the gelatinizing agent with the liquid, the mixture is aspirated by any known mechanical or electro-mechanical type aspirator. During aspiration, air bubbles are encapsulated in suspension within the resulting gel. The trapped air aids in filling the space within the bladder thus reducing the amount of gel requied to fill the bladder, with a proportionate reduction in the weight of the floatation system. The air bubbles also increase the heat transfer properties of the gel.

The reversible gelatinizing agent may, as an illustrative example, be the amoniated salt form of Carbopol (trademark B.F. Goodrich) resin. In this example, neutralized Carbopol resin is suspended in alcohol, or any other suitable liquid carrier in which the Carbopol resin will not dissolve. Isopropylalcohol has been found to be the preferred carrier because of its low toxicity in diluted form, its bacterial growth preventing properties, and its soluability in water which aids in distribution of the Carbopol resin when injected into water. A particular advantage to employing the gel formed by the addition of Carbopol resin to water is the substantially complete reversibility of the gel-forming reaction by the mere addition of common table salt. This, of course, facilitates the emptying of the floatation system when such is desired.

To form the floatation system according to this invention, the gelatinizing agent suspension is injected into the bladder. The flexible bladder is filled with water through the filler opening by a common garden hose as suggested above. The water strips away the alcohol exposing the gelatinizing agent to the water. On contact with the gel agent, the water swells and increases its viscosity to form a gel. It has been found that with a mixture of 0.15% to 0.30% by weight of Carbopol resin to water content, the resultant gel exhibits a viscosity of between 14000 and 20000 centi-poise as described by a Ferranti Viscosimeter at speeds 1, 2, 3, 4, 5 using VHB spindle. A gel within this viscosity range creates a floatation system which will give uniform and complete pressure distribution support for the human body but will not be subject to motion common in previous floatation systems.

The addition of a fungicide to the gel agent prevents bacterial growth in the floatation system after the formation of the gel therein. An effective fungicide compatible with Carbopol is methylene-blue. The amount of methylene-blue used is approximately 0.1% by weight in Carbopol, dry basis. The methylene-blue imparts a pleasing blue tint to the gel of the floatation system as well as substantially increasing the life of the floatation system by preventing bacterial growth.

From the foregoing it is apparent that there is herein provided an improved floatation system for a body-supporting structure. The floatation system includes a flexible bladder filled with water, a reversible gelatinizing agent, and a fungicide. The admixture is aspirated in order to achieve complete and uniform gel formation with entrapped air to reduce the weight of the floatation system, the floatation system having improved life characteristics due to the bacterial prevention by the fungicide.

The invention has been described in detail with particular reference to the preferred embodiments thereof, but it will be understood that variations and modifications can be effected within the spirit and scope of the invention.

I claim:

1. A floatation system for supporting at least a portion of the human body, said floatation system comprising:

a flexible enclosure; a gel-like substance encapsulating a plurality of air pockets within said enclosure for uniform distribution of body supportive forces by the floatation system, wherein said gel-like substance is water and a gelatinizing agent reversibly reactive with said water to form said gel, so that said gel-like substance is readily broken down into its original components, such agent being amoniated salt of Carbopol resin supended in a carrier, said Carbopol being of a weight between 0.15% and 0.30% of said water with which it is ultimately mixed; and a fungicide to prevent bacterial growth within said gel.

* * * * *